US010109914B2

(12) United States Patent
Caporal Del Barrio et al.

(10) Patent No.: US 10,109,914 B2
(45) Date of Patent: Oct. 23, 2018

(54) ANTENNA SYSTEM

(71) Applicant: Intel IP Corporation, Santa Clara, CA (US)

(72) Inventors: Samantha Caporal Del Barrio, Aalborg (DK); Pevand Bahramzy, Norresundby (DK); Poul Olesen, Stoevring (DK); Peter Bundgaard, Aalborg (DK); Alexandru Daniel Tatomirescu, Aalborg (DK); Emil Buskgaard, Aalborg (DK); Gert F. Pedersen, Storvorde (DK); Ole Jagielski, Frederikshavn (DK); Simon Svendsen, Aalborg (DK); Boyan Yanakiev, Aalborg (DK)

(73) Assignee: Intel IP Corporation, Santa Clara, CA (US)

( * ) Notice: Subject to any disclaimer, the term of this patent is extended or adjusted under 35 U.S.C. 154(b) by 317 days.

(21) Appl. No.: 14/671,470

(22) Filed: Mar. 27, 2015

(65) Prior Publication Data

US 2016/0285159 A1 Sep. 29, 2016

(51) Int. Cl.
*H01Q 1/50* (2006.01)
*H01Q 1/24* (2006.01)
(Continued)

(52) U.S. Cl.
CPC ..... *H01Q 1/50* (2013.01); *H01Q 1/242* (2013.01); *H01Q 1/38* (2013.01); *H01Q 5/314* (2015.01); *H01Q 7/00* (2013.01); *H01Q 7/005* (2013.01)

(58) Field of Classification Search
CPC ..... H01Q 1/50; H01Q 7/00; H01Q 1/242; H01Q 5/314; H01Q 7/005
(Continued)

(56) References Cited

U.S. PATENT DOCUMENTS 7,671,736 B2 * 3/2010 Iverson ..... G01D 21/00 340/539.1
8,134,506 B2 * 3/2012 Leisten ..... H01Q 1/243 343/702
(Continued)

FOREIGN PATENT DOCUMENTS

CN 104242976 A 12/2014
GB 2500209 A 9/2013
(Continued)

OTHER PUBLICATIONS

Search Report dated Aug. 22, 2016 for European Patent Application No. 16157031.2.
(Continued)

*Primary Examiner* — Huedung Mancuso
(74) *Attorney, Agent, or Firm* — Schiff Hardin LLP

(57) ABSTRACT

Antenna systems that can include first and second radiators and an electromagnetic coupler disposed adjacent to the first and the second radiators. The radiators can be tunable to one or more frequencies. The electromagnetic coupler can be, for example, an inductive coupler or a capacitive coupler. One or more of the antenna systems can be configured to use carrier aggregation by tuning the first and/or the second radiators. For example, one or more of the antenna systems can be configured to use inter-band aggregation, intra-band contiguous aggregation, and intra-band non-contiguous aggregation.

21 Claims, 11 Drawing Sheets

(51) Int. Cl.
*H01Q 7/00* (2006.01)
*H01Q 5/314* (2015.01)
*H01Q 1/38* (2006.01)

(58) Field of Classification Search
USPC ..... 343/861
See application file for complete search history.

(56) References Cited

U.S. PATENT DOCUMENTS 8,462,072 B2 * 6/2013 Andrenko ..... H01Q 1/38 343/700 MS
9,190,713 B2 * 11/2015 Eom ..... H01Q 1/243
2005/0007286 A1 * 1/2005 Trott ..... H01Q 13/085 343/770
2007/0000998 A1 * 1/2007 Lu ..... G06F 3/147 235/380
2008/0039137 A1 * 2/2008 Saegrov ..... G06K 7/10178 455/558
2008/0266190 A1 10/2008 Ohba et al.
2009/0153421 A1 6/2009 Rofougaran et al.
2009/0162123 A1 * 6/2009 Tsirline ..... B41J 11/02 400/76
2010/0001907 A1 * 1/2010 Wan ..... H01Q 9/30 343/700 MS
2011/0163937 A1 * 7/2011 Jung ..... H01Q 1/243 343/893
2011/0254749 A1 * 10/2011 Amari ..... H01Q 1/243 343/750
2013/0106660 A1 * 5/2013 Kang ..... H01Q 1/243 343/700 MS
2015/0048991 A1 2/2015 Pajona et al.
2015/0123864 A1 * 5/2015 Boryssenko ..... H01Q 9/16 343/813
2015/0138036 A1 * 5/2015 Harper ..... H01Q 1/48 343/848
2015/0147066 A1 * 5/2015 Benjamin ..... H04B 10/25758 398/116
2016/0087328 A1 * 3/2016 Lee ..... H01Q 5/307 343/702
2016/0301134 A1 * 10/2016 Li ..... H01Q 9/0421
2017/0012345 A1 * 1/2017 Zhang ..... H01Q 1/243
2017/0077967 A1 * 3/2017 Srirattana ..... H04B 1/0057

FOREIGN PATENT DOCUMENTS

JP 2010-39824 A 2/2010
WO WO-2014-064490 A1 5/2014

OTHER PUBLICATIONS

Office Action dated Apr. 4, 2018 for Chinese Application No. 201610108470.9.

* cited by examiner

ANTENNA SYSTEM

BACKGROUND

Field

Aspects described herein generally relate to antennas, including one or more tunable antennas.

Related Art

Wireless communication environments can use multi-antenna techniques that include multiple antennas at a transmitter, receiver, and/or transceiver. The multi-antenna techniques can be grouped into three different categories: diversity, interference suppression, and spatial multiplexing. These three categories are often collectively referred to as Multiple-input Multiple-output (MIMO) communication even though not all of the multi-antenna techniques that fall within these categories require at least two antennas at both the transmitter and receiver.

Carrier Aggregation (CA) is a feature of a mobile communication standard, such as, Release-10 of the 3GPP LTE-Advanced standard, which allows multiple resource blocks from/to multiple respective serving cells to be logically grouped together (aggregated) and allocated to the same wireless communication device. The aggregated resource blocks are known as component carriers (CCs) in the LTE-Advanced standard. Each of the wireless communication devices may receive/transmit multiple component carriers simultaneously from/to the multiple respective serving cells, thereby effectively increasing the downlink/uplink bandwidth of the wireless communication device(s). The term "component carriers (CCs)" is used to refer to groups of resource blocks (defined in terms or frequency and/or time) of two or more RF carriers that are aggregated (logically grouped) together.

There are various forms of Carrier Aggregation (CA) as defined by Release-10 of the LTE-Advanced standard, including intra-band contiguous (adjacent) CA, intra-band non-contiguous (non-adjacent) CA, and inter-band CA. In intra-band contiguous CA, aggregated component carriers (CCs) are within the same frequency band and adjacent to each other forming a contiguous frequency block. In intra-band non-contiguous CA, aggregated CCs are within the same frequency band but are not adjacent to each other. In inter-band CA, aggregated CCs are in different frequency bands.

Release-10 of the LTE-Advanced standard allows a maximum of five CCs to be allocated to a wireless communication device at any given time. CCs can vary in size from 1.4 to 20 MHz, resulting in a maximum bandwidth of 100 MHz that can be allocated to the wireless communication device in the downlink/uplink. The allocation of CCs to the wireless communication device is performed by the network and is communicated to the wireless communication device.

BRIEF DESCRIPTION OF THE DRAWINGS/FIGURES

The accompanying drawings, which are incorporated herein and form a part of the specification, illustrate the aspects of the present disclosure and, together with the description, further serve to explain the principles of the aspects and to enable a person skilled in the pertinent art to make and use the aspects.

The exemplary aspects of the present disclosure will be described with reference to the accompanying drawings. The drawing in which an element first appears is typically indicated by the leftmost digit(s) in the corresponding reference number.

DETAILED DESCRIPTION

In the following description, numerous specific details are set forth in order to provide a thorough understanding of the aspects of the present disclosure. However, it will be apparent to those skilled in the art that the aspects, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

In the following disclosure, one or more exemplary aspects can be implemented using wireless communications conforming to the Long-Term Evolution (LTE) and/or LTE Advanced standards. The LTE and LTE Advanced standards are developed by the 3rd Generation Partnership Project (3GPP) and described in the 3GPP Technical Specification 36 standard titled "Evolved Universal Terrestrial Radio Access (E-UTRA); Physical layer procedures," and the International Mobile Telecomunnications-2000 (IMT-2000) and IMT Advanced standards, all of which are incorporated herein by reference in their entirety.

As will be apparent to a person of ordinary skill in the art based on the teachings herein, exemplary aspects are not limited to the LTE and/or LTE Advanced standards, and can be applied to other cellular communication standards, including (but not limited to), Evolved High-Speed Packet Access (HSPA+), Wideband Code Division Multiple Access (W-CDMA), CDMA2000, Time Division-Synchronous Code Division Multiple Access (TD-SCDMA), Global System for Mobile Communications (GSM), General Packet Radio Service (GPRS), Enhanced Data Rates for GSM Evolution (EDGE), and/or Worldwide Interoperability for Microwave Access (WiMAX) (IEEE 802.16), and/or to one or more non-cellular communication standards, including (but not limited to) WLAN (IEEE 802.11), Bluetooth, Near-field Communication (NFC) (ISO/IEC 18092), ZigBee (IEEE 802.15.4), and/or Radio-frequency identification (RFID). These various standards and/or protocols are each incorporated herein by reference in their entirety.

Figure 1:
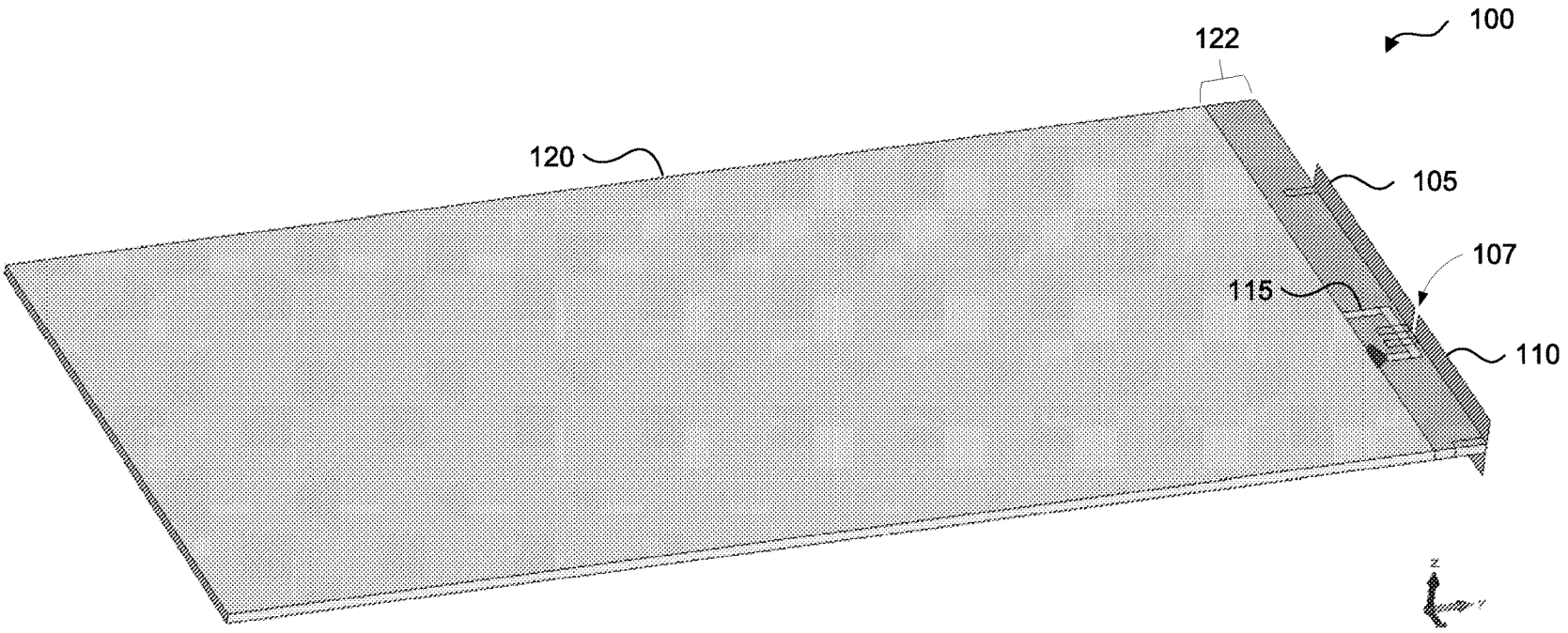
FIG. 1 illustrates an antenna system according to an exemplary aspect of the present disclosure.

FIG. 1 illustrates an antenna system 100 according to an exemplary aspect of the present disclosure. In an exemplary aspect, the antenna system 100 includes a first radiator 105, a second radiator 110, and an electromagnetic coupler 115. The radiators 105, 110 can be configured to convert one or more electrical signals into electromagnetic waves, and vice versa. The electromagnetic coupler 115 can be configured to connect (e.g., couple) a communication device (e.g., transmitter and/or receiver) to one or more of the radiators 105, 110. The electromagnetic coupler 115 can include one or more circuits having one or more active and/or passive components that are configured to match the impedance of one or more of the radiators 105, 110. In an exemplary aspect, the electromagnetic coupler 115 is an inductive coupler that is configured to inductively couple one or more of the radiators 105, 110 to one or more communication devices (e.g., transmitter, receiver, etc.). The electromagnetic coupler 115 is not limited to being an inductive coupler and can be configured as a capacitive coupler that can capacitively couple one or more of the radiators 105, 110. In an exemplary aspect, the antenna system 100 can be configured as a transmission antenna system, as a receiving antenna system or as both a transmitting and receiving antenna system. Further, two or more of the antenna systems 100 can be implemented within, or used by, a communication device, where one antenna system 100 is configured as a transmission antenna system and another antenna system 100 is configured as a receiving antenna system. For example, a first antenna system 100 can be configured on a first side of the PCB 120 as shown in FIG. 1 and a second antenna system 100 can be configured on another side (e.g., a side perpendicular to the first side) of the PCB 120. Further, two (or more) of the antenna systems 100 can be implemented within, or used by, a communication device, where the two antenna systems 100 are configured as transmission antennas. Similarly, the two antenna systems 100 can be configured as receiving antennas.

The antenna system 100 can be disposed on, for example, a printed circuit board (PCB) 120. The PCB 120 can be formed of, for example, glass reinforced epoxy laminate (e.g., FR-4) or one or more other materials as would be understood by one of ordinary skill in the relevant arts. The PCB 120 can be included in, for example, a communication device that is configured to use the antenna system 100. In an exemplary aspect, the radiators 105, 110 and the electromagnetic coupler 115 can be made of one or more metals, one or more metallic compounds, and/or one or more electrically conductive or semi-conductive materials as would be understood by one of ordinary skill in the relevant arts. The radiators 105, 110 and the electromagnetic coupler 115 can include one or more active or passive components (e.g., resistors, inductors, capacitors, etc.) and/or processor circuitry.

In an exemplary aspect, the first radiator 105 and the second radiator 110 can be configured to be tuned independently within a predetermined frequency range to one or more resonances. In an exemplary aspect, the frequency range can be, for example, 700 MHz to 960 MHz, but is not limited to this exemplary range. For example, the first radiator 105 can be configured to primarily operate at lower frequencies within the frequency range (e.g., at a first resonance), while the second radiator 110 can be figured to primarily operate at higher frequencies within the frequency range (e.g., at a second resonance). Although primarily operating at respective subsets of frequencies within the frequency range, the first and second radiators 105, 110 can be configured to operate at all frequencies within the frequency range. In operation, the first radiator 105 and/or the second radiator 110 can be configured to implement Carrier Aggregation (CA), including intra-band contiguous (adjacent) CA, intra-band non-contiguous (non-adjacent) CA, and/or inter-band CA.

In an exemplary aspect, the first radiator 105 has a length L1 that is greater than the length L2 of the second radiator 110. For example, the first radiator 105 can have a length of, for example, 23 mm and the second radiator 110 can have a length of, for example, 17 mm. The width of the first and second radiators 105, 110 can be, for example, 6 mm. The length/width of the radiators 105, 110 can be the same or different. Further, the space 107 between the first and second radiators 105, 110 can have a length of, for example, 1 mm. These dimensions should not be limited to these exemplary values, and the first radiator 105, the second radiator 110, and the space 107 can have other dimensions as would be understood by one of ordinary skill in the relevant arts.

As illustrated in FIG. 1, the first and second radiators 105, 110 and the electromagnetic coupler 115 can be disposed along an edge of the PCB 120. For example, first and second radiators 105, 110 and the electromagnetic coupler 115 can be disposed in an area 122 of the PCB 120 in which metallic or other conductive materials have been removed from the PCB 120. In this example, the first and second radiators 105, 110 can be disposed along an edge of the area 122 and/or one or more surfaces (e.g., top, bottom, etc.) of the PCB 120, and the electromagnetic coupler 115 can be disposed on one or more surfaces (e.g., top, bottom, etc.) of the PCB 120. Alternatively, the area 122 can represent a portion of the PCB 120 that has been removed. In this example, the first and second radiators 105, 110 and the electromagnetic coupler 115 can be configured to extend from an edge of the PCB 120 and within the area 122 in which a portion of the PCB 120 has been removed. The arrangement of the first and second radiators 105, 110 and the electromagnetic coupler 115 is described below with reference to FIGS. 2A-2C.

In an exemplary aspect, the first radiator 105 and the second radiator 110 can be arranged to have a space or slit 107 formed there between. Further, the electromagnetic coupler 115 can be arranged adjacent to the first and second radiators 105, 110 and the space 107. For example, the electromagnetic coupler 115 can be adjacent to and spaced from a portion of the first radiator 105 and a portion of the second radiator 110 whose adjacent edges define the space 107. In this configuration, the electromagnetic coupler 115 is spaced from the planar portion of the first radiator 105, the planar portion of the second radiator 110, and the space 107 formed between the first and second radiators 105, 110. The position of the electromagnetic coupler 115 is not limited to this configuration and may be positioned at other locations along the width of the PCB 120.

Figure 2A:
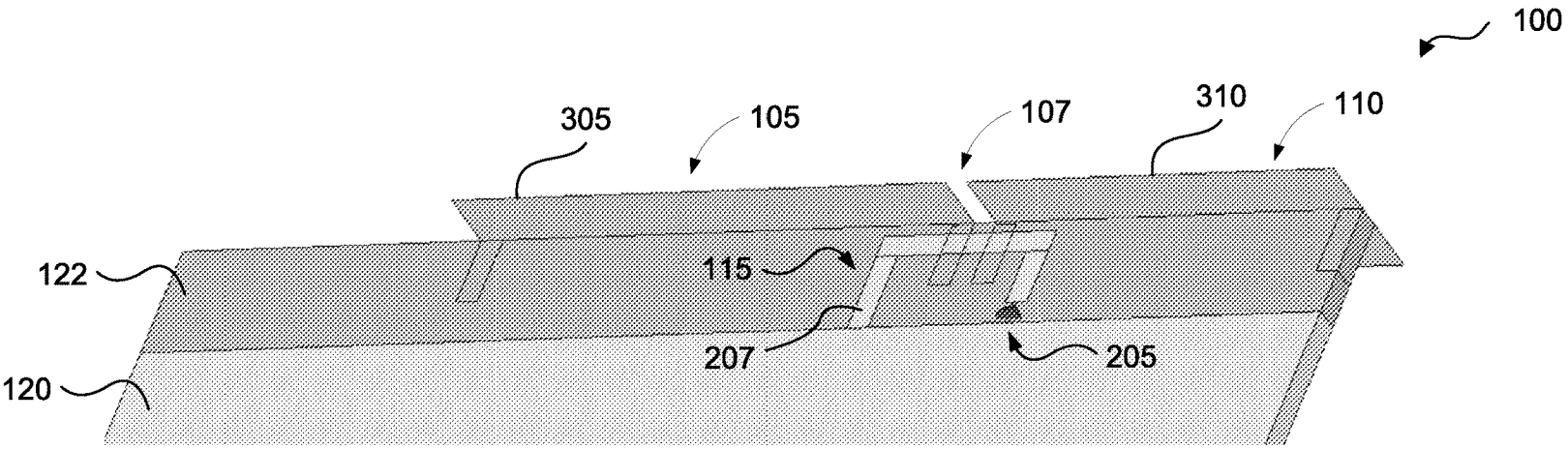
FIG. 2A illustrates a front prospective view of the antenna system illustrated in FIG. 1.
Figure 2B:
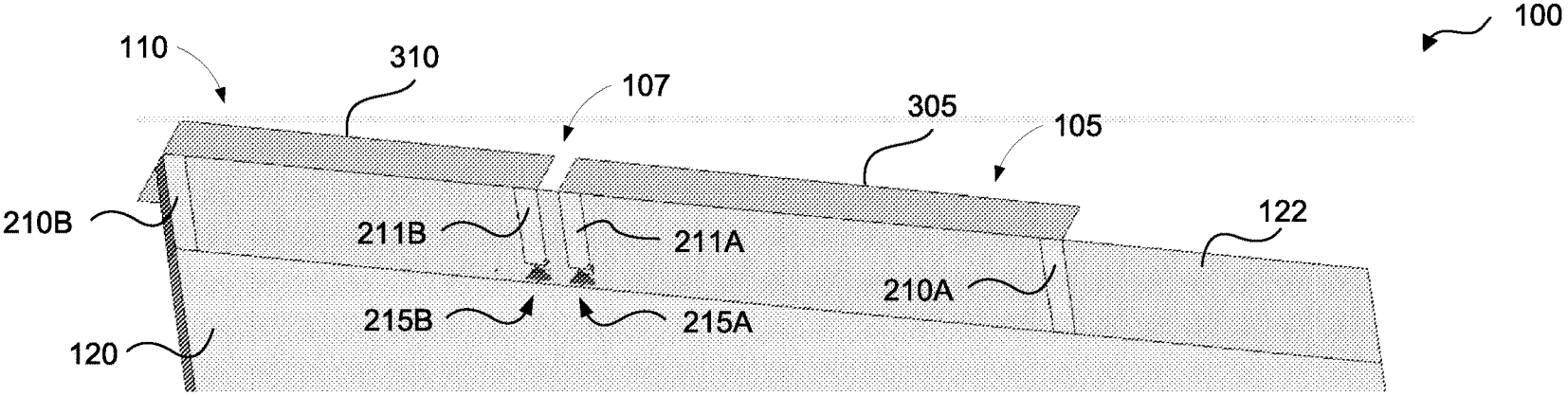
FIG. 2B illustrates a back prospective view of the antenna system illustrated in FIG. 1.
Figure 2C:
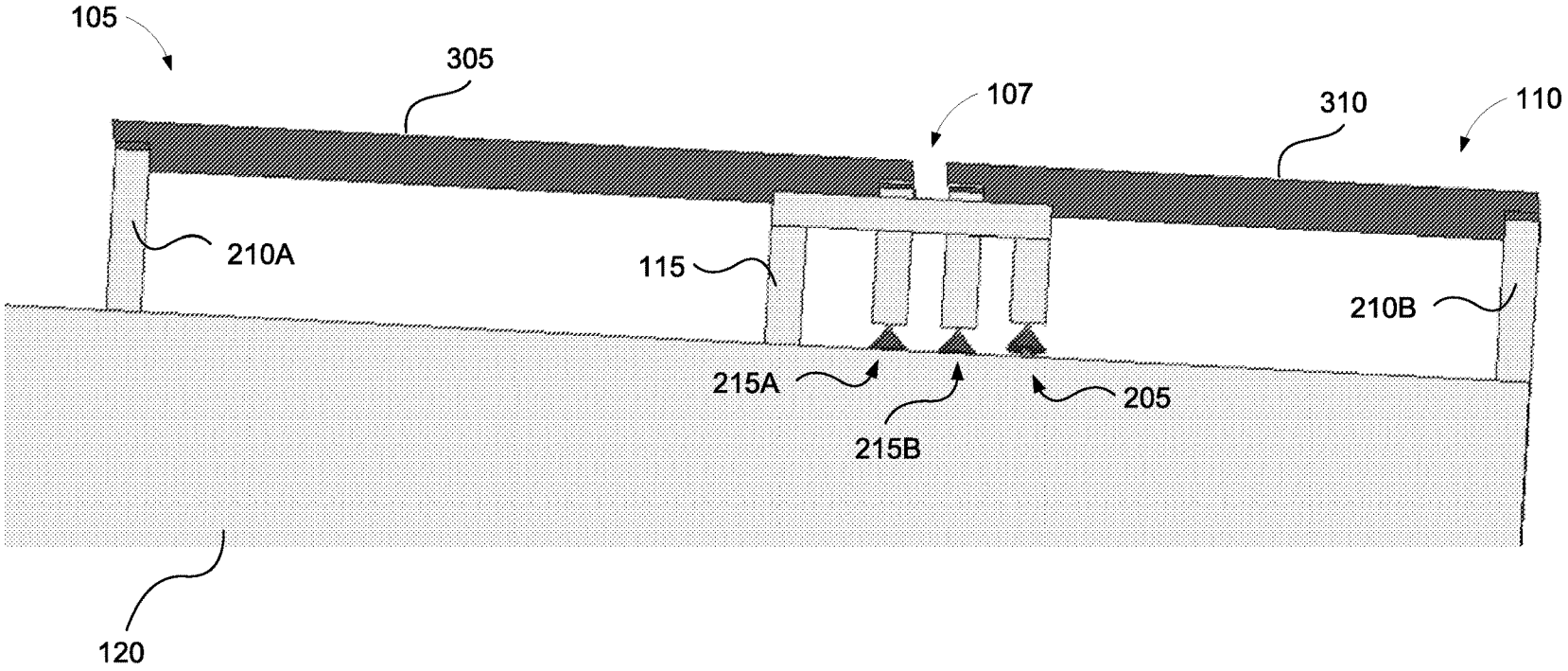
FIG. 2C illustrates another front prospective view of the antenna system illustrated in FIG. 1.

FIGS. 2A and 2B illustrate a front prospective view and a back prospective view of the antenna system 100 illustrated in FIG. 1, respectively. With reference to FIG. 2A, the electromagnetic coupler 115 is disposed on a front side of the PCB 120 in the area 122. With reference to FIG. 2B, the radiators 105, 110 are disposed on an edge of the area 122 of the PCB 120. FIG. 2C illustrates a front prospective view of the antenna system 100 in which the area 122 of the PCB 120 has been removed.

In an exemplary aspect, the first radiator 105 can be electrically connected to the PCB 120 via lead 210A extending from a first edge of the first radiator 105 and a lead 210B extending from a second edge of the first radiator 105. In an exemplary aspect, the first radiator 105 includes a capacitor 215A electrically connected between the PCB 120 and the lead 211A. In one or more exemplary aspects, the lead 210A and/or lead 210B can be connected to the PCB via one or more capacitors, inductors, and/or resistors. Alternatively, the lead 210A and/or lead 210B can be connected to the PCB directly.

Figures 3A, 3B, 3C:
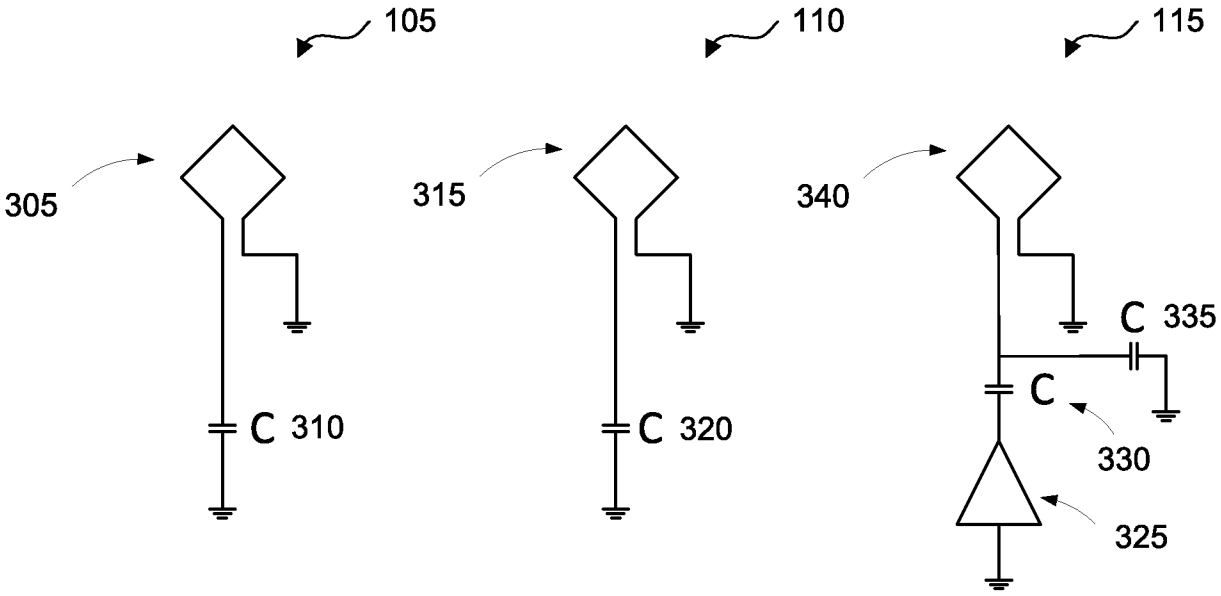
FIGS. 3A and 3B illustrate circuit diagrams of radiators according to exemplary aspects of the present disclosure.
FIG. 3C illustrates a circuit diagram of an electromagnetic coupler according to an exemplary aspect of the present disclosure.

FIG. 3A illustrates a circuit diagram of radiator 105 according to an exemplary aspect of the present disclosure. In an exemplary aspect, the first radiator 105 includes a first radiation portion 305 having a first end connected to ground and a second end connected to ground via a capacitor 310. In one or more exemplary aspects, the first end of the first radiation portion 305 can be connected to ground via one or more capacitors, inductors, and/or resistors. For example, with reference to FIG. 2B, the first radiator 105 can be connected to ground on the PCB 120 via lead 210A and to a capacitor 215A via lead 211A, where the capacitor 215A is further connected to ground on the PCB 120. In one or more exemplary aspects, the first radiator 105 can be connected to ground via one or more capacitors, inductors, and/or resistors. In an exemplary aspect, the capacitor 215A (310 in FIG. 3A) can be a fixed or tunable capacitor. In an exemplary aspect, the capacitor 215A (310 in FIG. 3A) can have a capacitance of, for example, 1-5 pF, 1-3 pF, 2-3 pF, or one or more other capacitances or tunable capacitance ranges as would be understood by those skilled in the relevant arts.

In an exemplary aspect, the second radiator 110 can be electrically connected to the PCB 120 via lead 210B extending from a first edge of the second radiator 110 and a lead 211B (as shown in FIG. 2B) extending from a second edge of the second radiator 110. In an exemplary aspect, the second radiator 110 includes a capacitor 215B electrically connected between the PCB 120 and the lead 211B.

FIG. 3B illustrates a circuit diagram of the second radiator 110 according to an exemplary aspect of the present disclosure. In an exemplary aspect, the second radiator 110 includes a first radiation portion 315 having a first end connected to ground and a second end connected to ground via a capacitor 320. For example, with reference to FIG. 2B, the second radiator 110 can be connected to ground on the PCB 120 via lead 210B and to a capacitor 215B via lead 211B, where the capacitor 215B is further connected to ground on the PCB 120. In an exemplary aspect, the capacitor 215B (320 in FIG. 3B) can be a fixed or tunable capacitor. In an exemplary aspect, the capacitor 215B (320 in FIG. 3B) can have a capacitance of, for example, 1-5 pF, 1-3 pF, 2-3 pF, or one or more other capacitances or tunable capacitance ranges as would be understood by those skilled in the relevant arts. In an exemplary aspect, the capacitance of capacitor 215B (320 in FIG. 3B) can be the same or different from the capacitance of capacitor 215A (310 in FIG. 3A).

With reference to FIG. 2A, the electromagnetic coupler 115 can be electrically connected to the PCB 120 via a feed and one or more passive components (e.g., capacitors, inductors, resistors, etc.) represented as 205 in FIG. 2A. For example, with reference to FIG. 3C, the electromagnetic coupler 115 can include two capacitors 330 and 335, and a coupling portion 340. The coupling portion 340 includes a first end electrically connected to ground and a second end electrically connected to ground via capacitor 335 and to feed 325 via capacitor 330. In an exemplary aspect, the first end of the coupling portion 340 can be connected to ground via one or more passive components (e.g., capacitors, inductors, resistors, etc.). The capacitors 330 and 335 can be fixed or tunable capacitors. In an exemplary aspect, the capacitors 330 and 335 can have a capacitance of, for example, 1-5 pF, 1-3 pF, 2-3 pF, or one or more other capacitances or tunable capacitance ranges as would be understood by those skilled in the relevant arts. In an exemplary aspect, the capacitance of capacitors 330 and 335 can be the same or different from each another.

With reference to FIG. 2C, the capacitors 330 and 335 represented by 205 are adjacent to the capacitor 215A and the capacitor 215B associated with the radiators 105 and 110, respectively. In this adjacent configuration, the capacitors 330 and 335, capacitor 215A, and the capacitor 215B can be implemented in a single chip. A single-chip implementation can be used to reduce the cost of the exemplary aspect. The capacitors are not limited to a single-chip implementation and the capacitors can be implemented in two or more chips.

Figure 4:
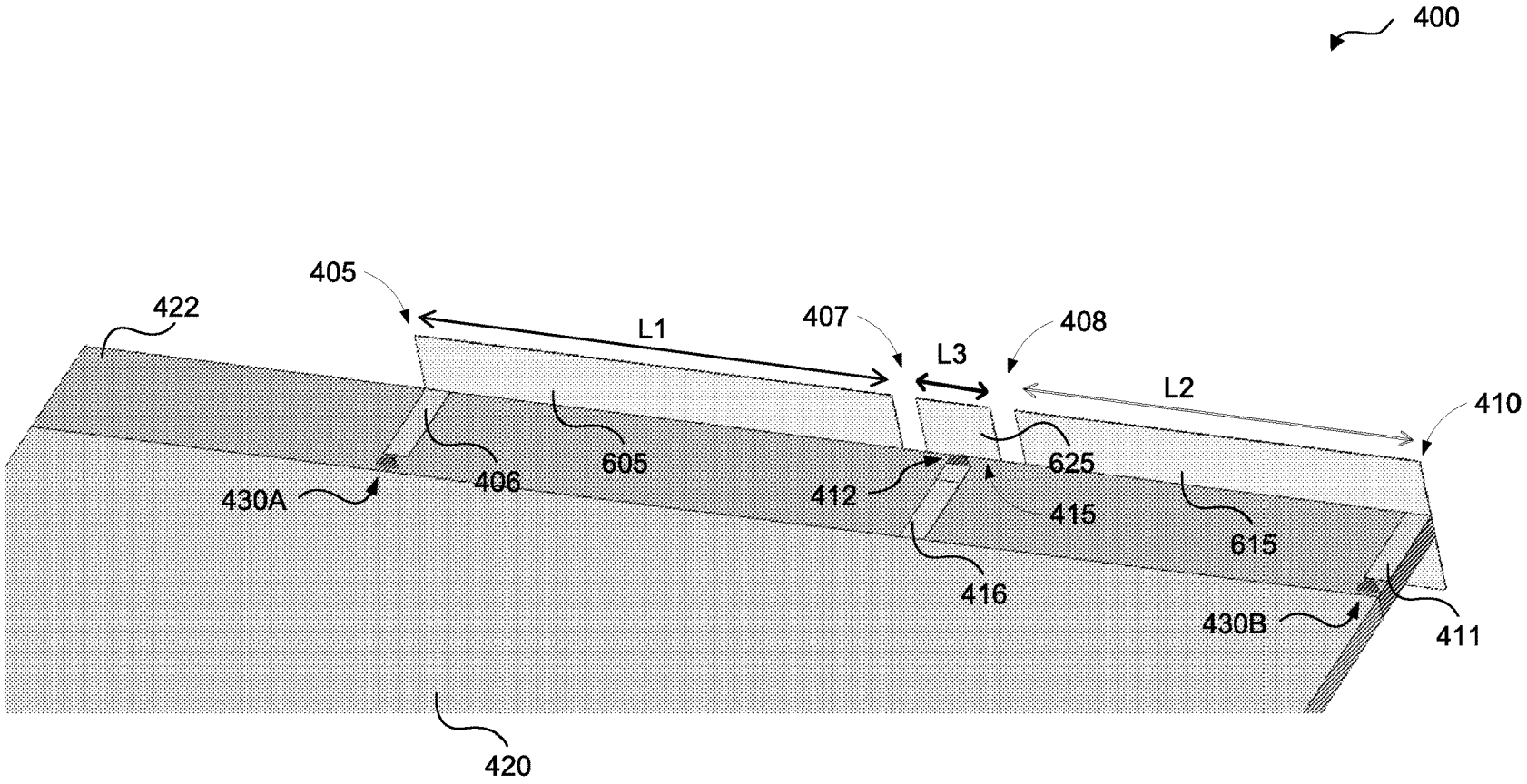
FIG. 4 illustrates an antenna system according to an exemplary aspect of the present disclosure.

FIG. 4 illustrates an antenna system 400 according to an exemplary aspect of the present disclosure. In an exemplary aspect, the antenna system 400 includes a first radiator 405, a second radiator 410, and an electromagnetic coupler 415. The radiators 405, 410 can be configured to convert one or more electrical signals into electromagnetic waves, and vice versa. The electromagnetic coupler 415 can be configured to connect (e.g., couple) a communication device (e.g., transmitter and/or receiver) to one or more of the radiators 405, 410. The electromagnetic coupler 415 can include one or more circuits having one or more active and/or passive components that are configured to match the impedance of one or more of the radiators 405, 410. In an exemplary aspect, the electromagnetic coupler 415 is a capacitive coupler that is configured to capacitively couple one or more of the radiators 405, 410 to one or more communication devices (e.g., transmitter, receiver, etc.). The electromagnetic coupler 415 is not limited to being a capacitive coupler and can be configured as an inductive coupler that can inductively couple one or more of the radiators 405, 410.

The antenna system 400 can be disposed on, for example, a printed circuit board (PCB) 420. The PCB 420 can be formed of, for example, glass reinforced epoxy laminate (e.g., FR-4) or one or more other materials as would be understood by one of ordinary skill in the relevant arts. The PCB 420 can be included in, for example, a communication device that is configured to use the antenna system 400. In an exemplary aspect, the radiators 405, 410 and the electromagnetic coupler 415 can be made of one or more metals, one or more metallic compounds, and/or one or more electrically conductive or semi-conductive materials as would be understood by one of ordinary skill in the relevant arts. The radiators 405, 410 and the electromagnetic coupler 415 can include one or more active or passive components (e.g., resistors, inductors, capacitors, etc.) and/or processor circuitry.

In an exemplary aspect, the antenna system 400 can be configured as a transmission antenna system, as a receiving antenna system or as both a transmitting and receiving antenna system. Further, two or more of the antenna systems 400 can be implemented within, or used by, a communication device, where one antenna system 100 is configured as a transmission antenna system and another antenna system 400 is configured as a receiving antenna system. For example, a first antenna system 400 can be configured on a first side of the PCB 420 as shown in FIG. 4 and a second antenna system 400 can be configured on another side (e.g., a side perpendicular to the first side) of the PCB 420. In one or more aspects, two (or more) of the antenna systems 100 can be implemented within, or used by, a communication device, where the two antenna systems 100 are configured as transmission antennas. Similarly, the two antenna systems 100 can be configured as receiving antennas.

In an exemplary aspect, the first radiator 405 and the second radiator 410 can be configured to be tuned independently within a predetermined frequency range to one or more resonances. For example, the first radiator 405 can be configured to primarily operate at lower frequencies within the frequency range (e.g., at a first resonance), while the second radiator 110 can be figured to primarily operate at higher frequencies within the frequency range (e.g., at a second resonance). Although primarily operating at respective subsets of frequencies within the frequency range, the first and second radiators 405, 410 can be configured to operate at all frequencies within the frequency range. In operation, the first radiator 405 and/or the second radiator 410 can be configured to implement Carrier Aggregation (CA), including intra-band contiguous (adjacent) CA, intra-band non-contiguous (non-adjacent) CA, and/or inter-band CA.

In an exemplary aspect, the first radiator 405 has a length L1 that is greater than the length L2 of the second radiator 410. For example, the first radiator 105 can have a length of, for example, 19.5 mm and the second radiator 410 can have a length of, for example, 16.5 mm. The width of the first and second radiators 405, 410 can be, for example, 6 mm. The length/width of the radiators 405, 410 can be the same or different. These dimensions should not be limited to these exemplary values, and the first radiator 405 and/or the second radiator 410 can have other dimensions as would be understood by one of ordinary skill in the relevant arts.

As illustrated in FIG. 4, the first and second radiators 405, 410 and the electromagnetic coupler 415 can be disposed along an edge of the PCB 120. For example, first and second radiators 405, 410 and the electromagnetic coupler 115 can be disposed in an area 422 of the PCB 420 in which metallic or other conductive materials have been removed from the PCB 420. In this example, the first and second radiators 405, 410 and the electromagnetic coupler 415 can be disposed along an edge of the area 422 and/or one or more surfaces (e.g., top, bottom, etc.) of the PCB 420. The electromagnetic coupler 415 can have a length of, for example, 3 mm and be spaced from the each of the radiators 405 and 410 forming spaces 407 and 408, respectively. The distance between the electromagnetic coupler 415 and the radiators 405 and 410 can be the same or different. The distance can be, for example, 1 mm. These dimensions should not be limited to these exemplary values, and the first radiator 405, the second radiator 410, electromagnetic coupler 415, and/or one or both of the spaces 407 and 408 formed therebetween can have other dimensions as would be understood by one of ordinary skill in the relevant arts.

In an exemplary aspect, the radiators 405, 410 and the electromagnetic coupler 415 can be arranged such that a space or slit 407 is formed between the electromagnetic coupler 415 and the first radiator 405, and a space or slit 408 is formed between the electromagnetic coupler 415 and the second radiator 410. Further, the electromagnetic coupler 415 can be disposed in the same or substantially the same plane as the radiators 405, 410. For example, the electromagnetic coupler 415 can be disposed on the edge of the area 422 and in between the radiators 405 and 410 also disposed on the edge of the area 422. In this example, adjacent edges of the first radiator 405 and the electromagnetic coupler 415 define the space 407 and adjacent edges of the second radiator 410 and the electromagnetic coupler 415 define the space 408.

Figures 6A, 6B, 6C:
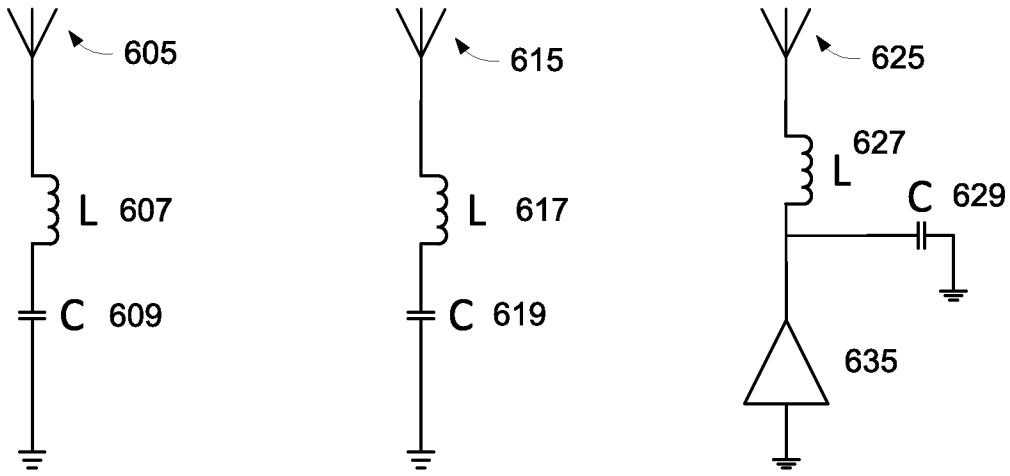
FIGS. 6A and 6B illustrate circuit diagrams of radiators according to exemplary aspects of the present disclosure.
FIG. 6C illustrates a circuit diagram of an electromagnetic coupler according to an exemplary aspect of the present disclosure.

With continued reference to FIG. 4 and with reference to FIGS. 6A-6C, the first radiator 405 can include a first radiation portion 605 that is connected to ground via lead 406 and one or more components (e.g., one or more inductors, capacitors, and/or resistors). In an exemplary aspect, the first radiation portion 605 is connected to ground via an inductor 607 and a capacitor 609 connected in series. In this configuration, a first end of the radiation portion 605 of the first radiator 405 is floating while a second end of the radiation portion 605 that is opposite the first end is connected to the lead 406 and the one or more components (e.g., inductor 607 and a capacitor 609 connected in series). The inductor 607 and capacitor 609 are represented by 430A in FIG. 4. In an exemplary aspect, the capacitor 609 is a tunable capacitor. However, the capacitor 609 can be a fixed capacitor in one or more of the aspects. In an exemplary aspect, the inductor 607 can have an inductance of, for example, 1-100 nH, 1-50 nH, 10-50 nH, 20-45 nH, 35-45 nH, 44 nH, or another inductance value as would be understood by those skilled in the relevant arts. The inductor 607 is not limited to this example inductance and can another inductance value as would be understood by those skilled in the relevant arts. The capacitor 609 can have a capacitance of, for example, 1-5 pF, 1-4.5 pF, 1-3 pF, 2-4 pF, or one or more other capacitances or tunable capacitance ranges as would be understood by those skilled in the relevant arts.

Similarly, the second radiator 410 can include a second radiation portion 615 that is connected to ground via lead 411 and one or more components (e.g., one or more inductors, capacitors, and/or resistors). In an exemplary aspect, the second radiation portion 615 is connected to ground via an inductor 617 and a capacitor 619 connected in series. In this configuration, a first end of the radiation portion 615 of the first radiator 410 is floating while a second end of the radiation portion 615 that is opposite the first end is connected to the lead 411 and the one or more components (e.g., inductor 617 and a capacitor 619 connected in series). The inductor 617 and capacitor 619 are represented by 430B in FIG. 4. In an exemplary aspect, the capacitor 619 is a tunable capacitor. However, the capacitor 619 can be a fixed capacitor in one or more of the aspects. In an exemplary aspect, the inductor 617 can have an inductance of, for example, 1-100 nH, 1-50 nH, 10-50 nH, 20-45 nH, 35-45 nH, or 41 nH. The inductor 617 is not limited to this example inductance and can have another inductance value as would be understood by those skilled in the relevant arts. The capacitor 619 can have a capacitance of, for example, 1-5 pF, 1-4.5 pF, 1-3 pF, 2-4 pF, or one or more other capacitances or tunable capacitance ranges as would be understood by those skilled in the relevant arts.

The electromagnetic coupler 415 can include a coupling portion 625 that is connected to ground via one or more components (e.g., one or more inductors, capacitors, and/or resistors) and lead 416. In an exemplary aspect, the coupling portion is connected to ground via an inductor 627 and a capacitor 629 connected in series. The coupling portion 625 can also be connected to a feed 635 via the inductor 627. In this example, the feed 635, inductor 627 and capacitor 629 are represented by 412 located at the end of lead 416 as shown in FIG. 4. In an exemplary, the electromagnetic coupler 415 is a capacitive coupler. The electromagnetic coupler 415 is not limited to being a capacitive coupler and can be configured as an inductive coupler. In an exemplary aspect, the capacitor 629 is a fixed capacitor. However, the capacitor 629 can be a tunable capacitor in one or more of the aspects. The capacitor 629 can have a capacitance of, for example, 1-20 pF, 1-10 pF, 1-5 pF, 2-4 pF, 3-4.5 pF, 3.5-4.5 pF, 4 pF, or one or more other capacitances or tunable capacitance ranges as would be understood by those skilled in the relevant arts. In an exemplary aspect, the inductor 627 can have an inductance of, for example, 1-100 nH, 1-50 nH, 1-10 nH, 10-50 nH, 20-45 nH, 35-45 nH, or 6 nH. The inductor 627 is not limited to this example inductance and can another inductance value as would be understood by those skilled in the relevant arts.

In an exemplary aspect, the inductor 607 and capacitor 609 (i.e., 430A) and/or the inductor 617 and capacitor 619 (i.e., 430B) can be located adjacent to the feed 635, inductor 627 and capacitor 629 represented as 412. In this configuration, the inductor 607, capacitor 609, inductor 617, capacitor 619, feed 635, inductor 627 and capacitor 629 can be implemented in a single chip. The components can also be implemented on a plurality of chips, where one or more of the chips include two or more of the components. In these examples, the leads connecting the radiation portions 605, 615 can be connected to 430A and 430B, respectively, via corresponding wires disposed on the PCB 420. For example, 430A located near 412 can have a wire running along the PCB 420 to the lead connecting to the radiator 405. A similar configuration can be used for 430B and the second radiator 410.

Figure 5A:
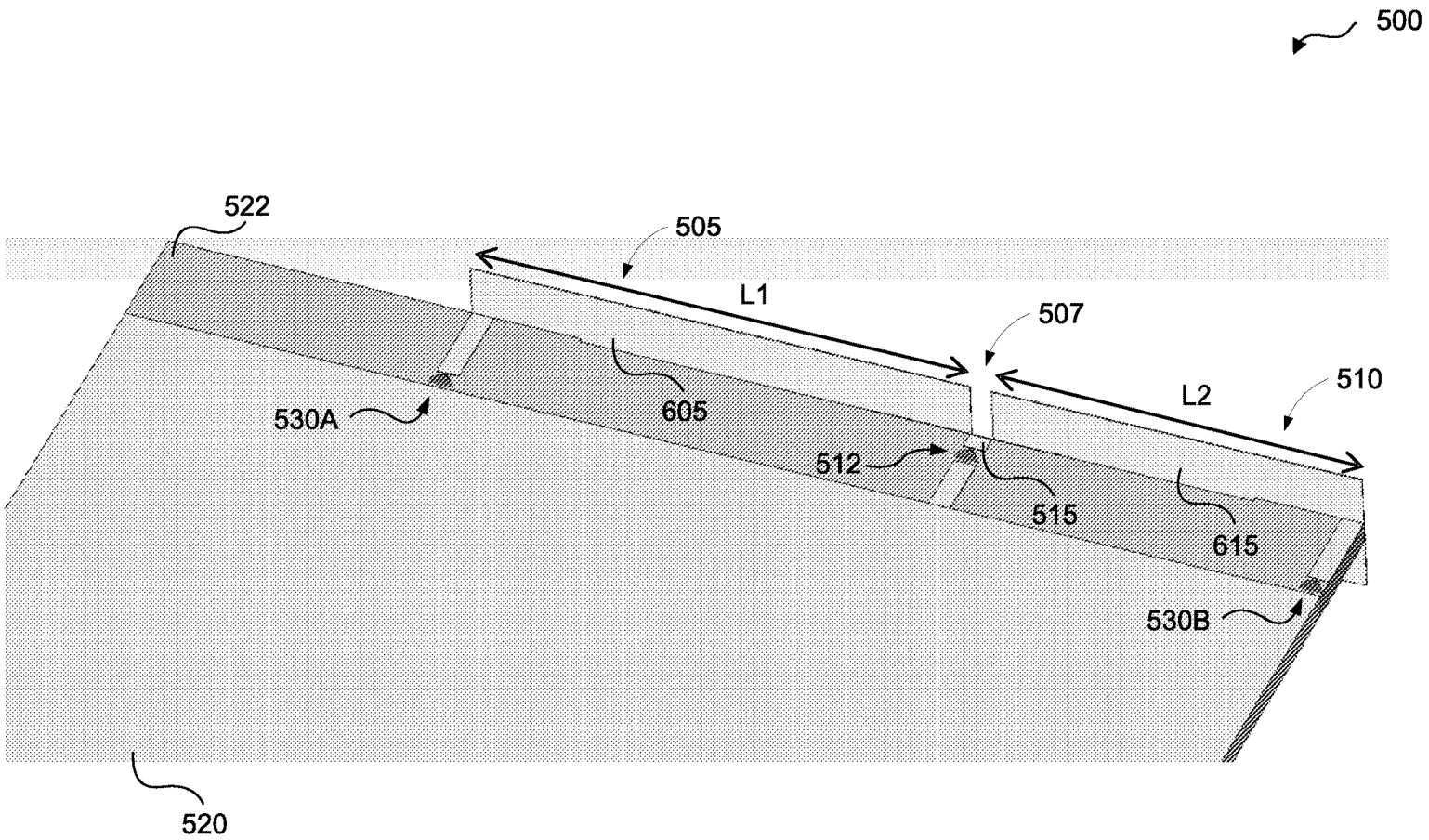
FIGS. 5A and 5B illustrate antenna systems according to exemplary aspects of the present disclosure.
Figure 5B:
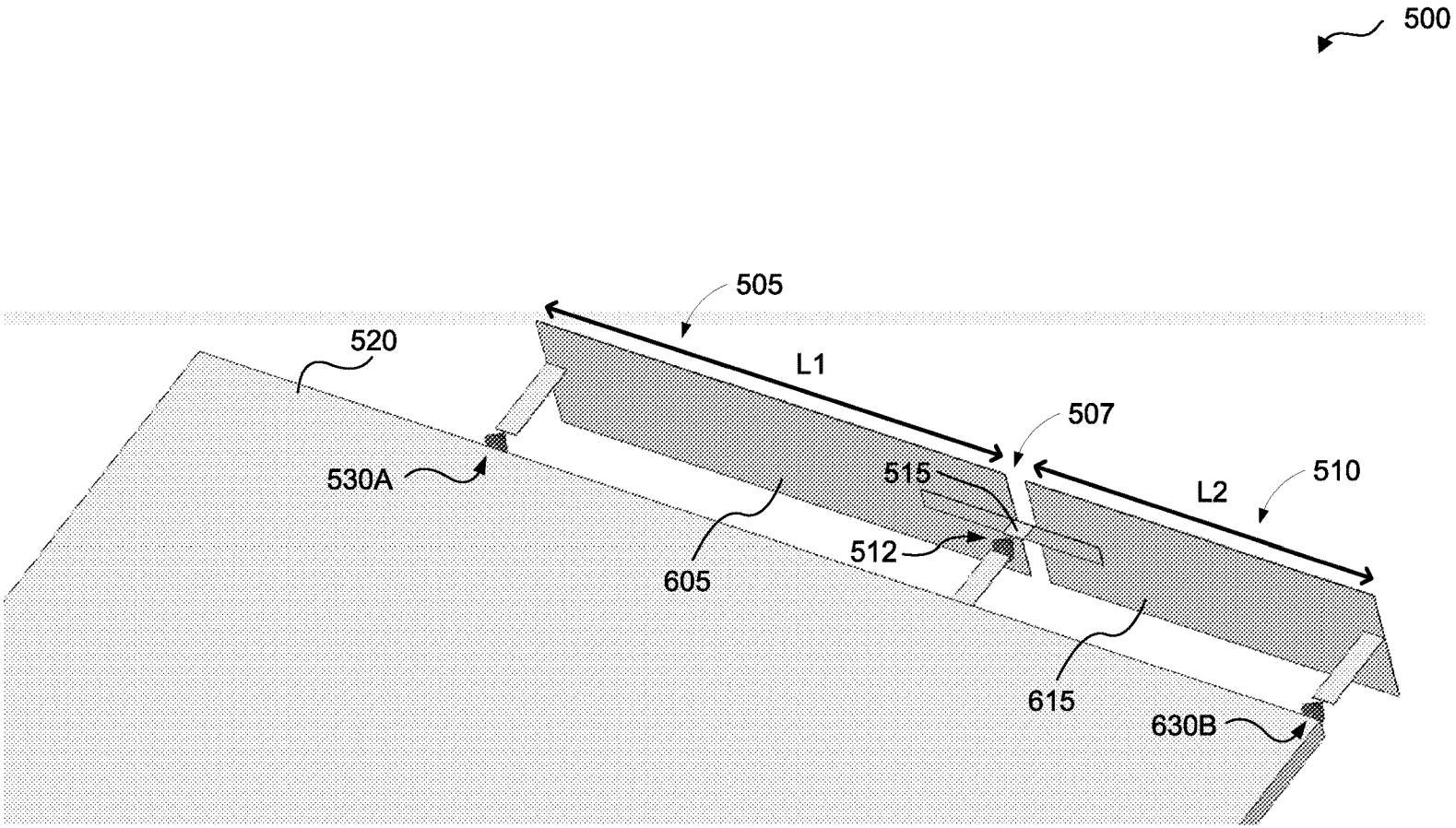

FIG. 5A illustrates an antenna system 500 according to an exemplary aspect of the present disclosure. FIG. 5B illustrates the antenna system 500 having the area 522 of the PCB 520 removed. In an exemplary aspect, the first radiator 505, the second radiator 510 and the electromagnetic coupler 515 can be represented by the circuits illustrated in FIGS. 6A-6C, respectively. Because the circuits of FIGS. 6A-6C have been discussed above with respect to FIG. 4, further discussion with respect to FIGS. 5A and 5B has been omitted for brevity.

In an exemplary aspect, the antenna system 500 includes a first radiator 505, a second radiator 510, and an electromagnetic coupler 515. The radiators 505, 510 can be configured to convert one or more electrical signals into electromagnetic waves, and vice versa. The electromagnetic coupler 515 can be configured to connect (e.g., couple) a communication device (e.g., transmitter and/or receiver) to one or more of the radiators 505, 510. The electromagnetic coupler 515 can include one or more circuits having one or more active and/or passive components that are configured to match the impedance of one or more of the radiators 505, 510. In an exemplary aspect, the electromagnetic coupler 515 is a capacitive coupler that is configured to capacitively couple one or more of the radiators 505, 510 to one or more communication devices (e.g., transmitter, receiver, etc.). The electromagnetic coupler 515 is not limited to being a capacitive coupler and can be configured as an inductive coupler that can inductively couple one or more of the radiators 505, 510.

The antenna system 500 can be disposed on, for example, a printed circuit board (PCB) 520. The PCB 520 can be formed of, for example, glass reinforced epoxy laminate (e.g., FR-4) or one or more other materials as would be understood by one of ordinary skill in the relevant arts. The PCB 520 can be included in, for example, a communication device that is configured to use the antenna system 500. In an exemplary aspect, the radiators 505, 510 and the electromagnetic coupler 515 can be made of one or more metals, one or more metallic compounds, and/or one or more electrically conductive or semi-conductive materials as would be understood by one of ordinary skill in the relevant arts. The radiators 505, 510 and the electromagnetic coupler 515 can include one or more active or passive components (e.g., resistors, inductors, capacitors, etc.) and/or processor circuitry.

In an exemplary aspect, the antenna system 500 can be configured as a transmission antenna system, as a receiving antenna system or as both a transmitting and receiving antenna system. Further, two or more of the antenna systems 500 can be implemented within, or used by, a communication device, where one antenna system 500 is configured as a transmission antenna system and another antenna system 500 is configured as a receiving antenna system. For example, a first antenna system 500 can be configured on a first side of the PCB 520 as shown in FIG. 1 and a second antenna system 500 can be configured on another side (e.g., a side perpendicular to the first side) of the PCB 520. In one or more aspects, two (or more) of the antenna systems 500 can be implemented within, or used by, a communication device, where the two antenna systems 500 are configured as transmission antennas. Similarly, the two antenna systems 500 can be configured as receiving antennas.

In an exemplary aspect, the first radiator 505 and the second radiator 510 can be configured to be tuned independently within a predetermined frequency range to one or more resonances. For example, the first radiator 505 can be configured to primarily operate at lower frequencies within the frequency range (e.g., at a first resonance), while the second radiator 110 can be figured to primarily operate at higher frequencies within the frequency range (e.g., at a second resonance). Although primarily operating at respective subsets of frequencies within the frequency range, the first and second radiators 505, 510 can be configured to operate at all frequencies within the frequency range. In operation, the first radiator 505 and/or the second radiator 510 can be configured to implement Carrier Aggregation (CA), including intra-band contiguous (adjacent) CA, intra-band non-contiguous (non-adjacent) CA, and/or inter-band CA.

In an exemplary aspect, the first radiator 505 has a length L1 that is greater than the length L2 of the second radiator 510. For example, the first radiator 105 can have a length of, for example, 23 mm and the second radiator 510 can have a length of, for example, 17 mm. The length/width of the first and second radiators 505, 510 can be, for example, 6 mm. The width of the radiators 505, 510 can be the same or different. These dimensions should not be limited to these exemplary values, and the first radiator 505 and/or the second radiator 510 can have other dimensions as would be understood by one of ordinary skill in the relevant arts.

As illustrated in FIGS. 5A-5B, the first and second radiators 505, 510 and the electromagnetic coupler 515 can be disposed along an edge of the PCB 520. For example, first and second radiators 505, 510 and the electromagnetic coupler 515 can be disposed in an area 522 of the PCB 520 in which metallic or other conductive materials have been removed from the PCB 520. In this example, the first and second radiators 505, 510 and the electromagnetic coupler 515 can be disposed along an edge of the area 522 and/or one or more surfaces (e.g., top, bottom, etc.) of the PCB 520.

In an exemplary aspect, the first radiator 505 and the second radiator 510 can be arranged to have a space or slit 507 formed there between. Further, the electromagnetic coupler 515 can be arranged adjacent to the first and second radiators 505, 510 and the space 507. For example, the electromagnetic coupler 515 can be adjacent to and spaced from a portion of the first radiator 505 and a portion of the second radiator 510 whose respective edges define the space 507. In this configuration, the electromagnetic coupler 515 is spaced from the planar portion of the first radiator 505 (e.g., radiation portion 605), the planar portion of the second radiator 510 (e.g., radiation portion 615), and the space 507 formed between the first and second radiators 505, 510. The position of the electromagnetic coupler 515 is not limited to this configuration and may be positioned at other locations along the width of the PCB 520.

In an exemplary aspect, the electromagnetic coupler 515 is spaced from a plane in which the radiation portions 605 and 615 reside. That is, there is an air gap between the electromagnetic coupler 515 and the radiation portions 605 and 615. The electromagnetic coupler 515 can have a length that is equal or substantially equal to the length of the space 507. In an exemplary aspect, as illustrated in FIG. 5B, the electromagnetic coupler 515 can have a length so that the electromagnetic coupler 515 extends from the space 507 along at least a portion of the radiators 505, 510 (e.g., along radiation portions 605 and 615). In this example, there is an air gap between the electromagnetic coupler 515 and the radiation portions 605 and 615. The distance between the electromagnetic coupler 515 and the radiation portions 605 and 615 can be the same or different. In an exemplary aspect, the electromagnetic coupler 515 includes a first portion that is substantially parallel to the top and bottom surfaces of the PCB 520 and a second portion that is substantially parallel to the radiation portions 605, 615 of the radiators 505, 510, respectively. In this example, the second portion of the electromagnetic coupler 515 extends from the space 507 along at least a portion of the radiation portions 605 and 615. In an exemplary aspect, the first portion and the second portion of the electromagnetic coupler form an angle of 90° or substantially 90°, but are not limited to this angled configuration.

Figure 7:
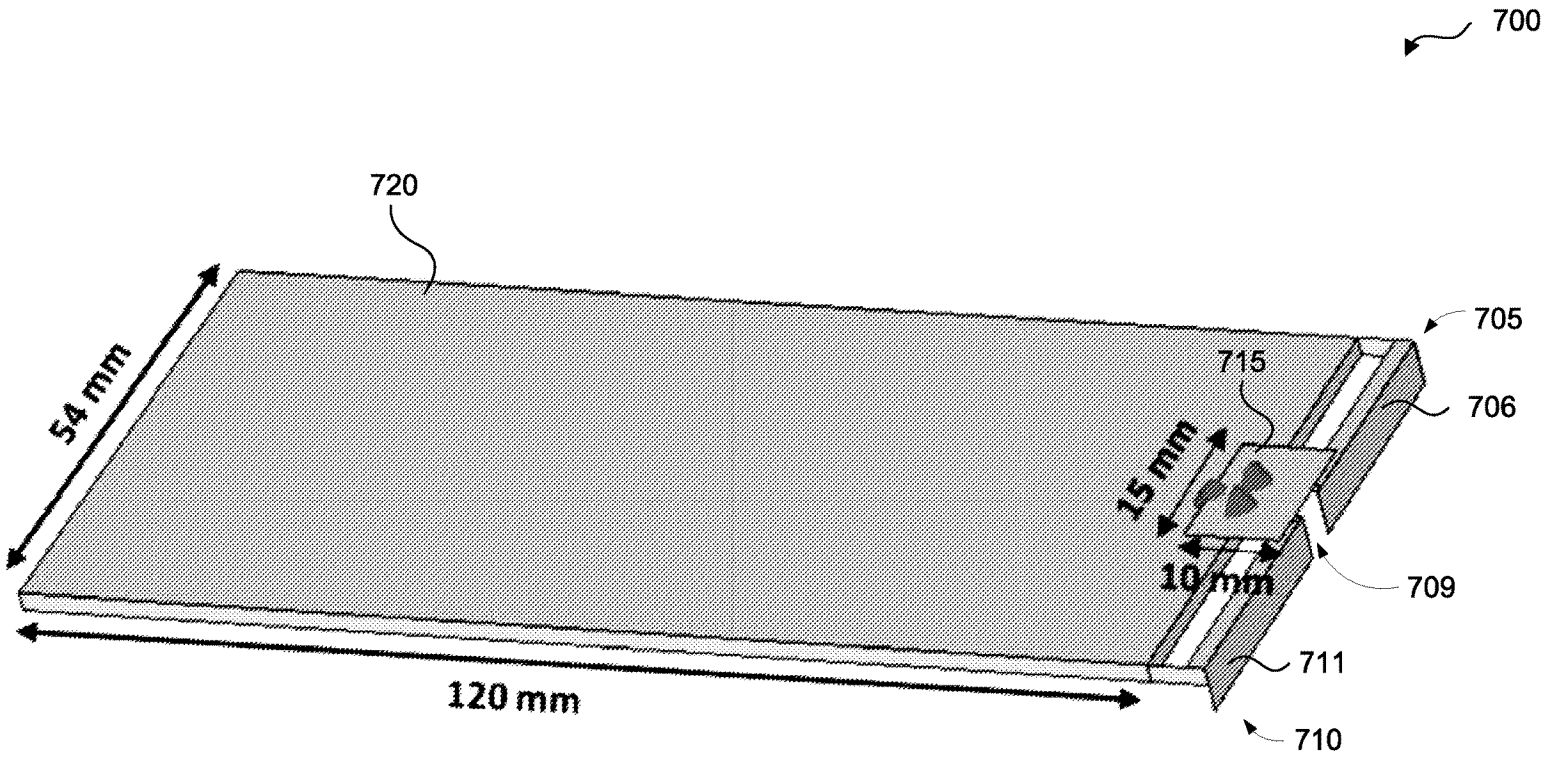
FIG. 7 illustrates an antenna system according to an exemplary aspect of the present disclosure.

FIG. 7 illustrates an antenna system 700 according to an exemplary aspect of the present disclosure. Although example dimensions are shown in FIG. 7, the exemplary aspects are not limited to these dimensions.

In an exemplary aspect, the antenna system 700 includes a first radiator 705, a second radiator 710, and an electromagnetic coupler 715. The radiators 705, 710 can be configured to convert one or more electrical signals into electromagnetic waves, and vice versa. The electromagnetic coupler 715 can be configured to connect (e.g., couple) a communication device (e.g., transmitter and/or receiver) to one or more of the radiators 705, 710. The electromagnetic coupler 715 can include one or more circuits having one or more active and/or passive components that are configured to match the impedance of one or more of the radiators 705, 710. In an exemplary aspect, the electromagnetic coupler 715 is a capacitive coupler that is configured to capacitively couple one or more of the radiators 705, 710 to one or more communication devices (e.g., transmitter, receiver, etc.). The electromagnetic coupler 715 is not limited to being a capacitive coupler and can be configured as an inductive coupler that can inductively couple one or more of the radiators 705, 710.

The antenna system 700 can be disposed on, for example, a printed circuit board (PCB) 720. The PCB 720 can be formed of, for example, glass reinforced epoxy laminate (e.g., FR-4) or one or more other materials as would be understood by one of ordinary skill in the relevant arts. The PCB 720 can be included in, for example, a communication device that is configured to use the antenna system 700. In an exemplary aspect, the radiators 705, 710 and the electromagnetic coupler 715 can be made of one or more metals, one or more metallic compounds, and/or one or more electrically conductive or semi-conductive materials as would be understood by one of ordinary skill in the relevant arts. The radiators 705, 710 and the electromagnetic coupler 715 can include one or more active or passive components (e.g., resistors, inductors, capacitors, etc.) and/or processor circuitry.

In an exemplary aspect, the antenna system 700 can be configured as a transmission antenna system, as a receiving antenna system or as both a transmitting and receiving antenna system. Further, two or more of the antenna systems 700 can be implemented within, or used by, a communication device, where one antenna system 700 is configured as a transmission antenna system and another antenna system 700 is configured as a receiving antenna system. For example, a first antenna system 700 can be configured on a first side of the PCB 720 as shown in FIG. 7 and a second antenna system 700 can be configured on another side (e.g., a side perpendicular to the first side) of the PCB 720.

In an exemplary aspect, the first radiator 705 and the second radiator 710 can be configured to be tuned independently within a predetermined frequency range to one or more resonances. For example, the first radiator 705 can be configured to primarily operate at lower frequencies within the frequency range (e.g., at a first resonance), while the second radiator 110 can be figured to primarily operate at higher frequencies within the frequency range (e.g., at a first resonance). Although primarily operating at respective subsets of frequencies within the frequency range, the first and second radiators 705, 710 can be configured to operate at all frequencies within the frequency range. For example, each of the radiators 705 and 710 can be configured to address the lower or the upper band. This allows for addressing of bands where transmit and receive bands are reversed as in, for example, band 13 and band 14. In operation, the first radiator 705 and/or the second radiator 710 can be configured to implement Carrier Aggregation (CA), including intra-band contiguous (adjacent) CA, intra-band non-contiguous (non-adjacent) CA, and/or inter-band CA.

Figure 8A:
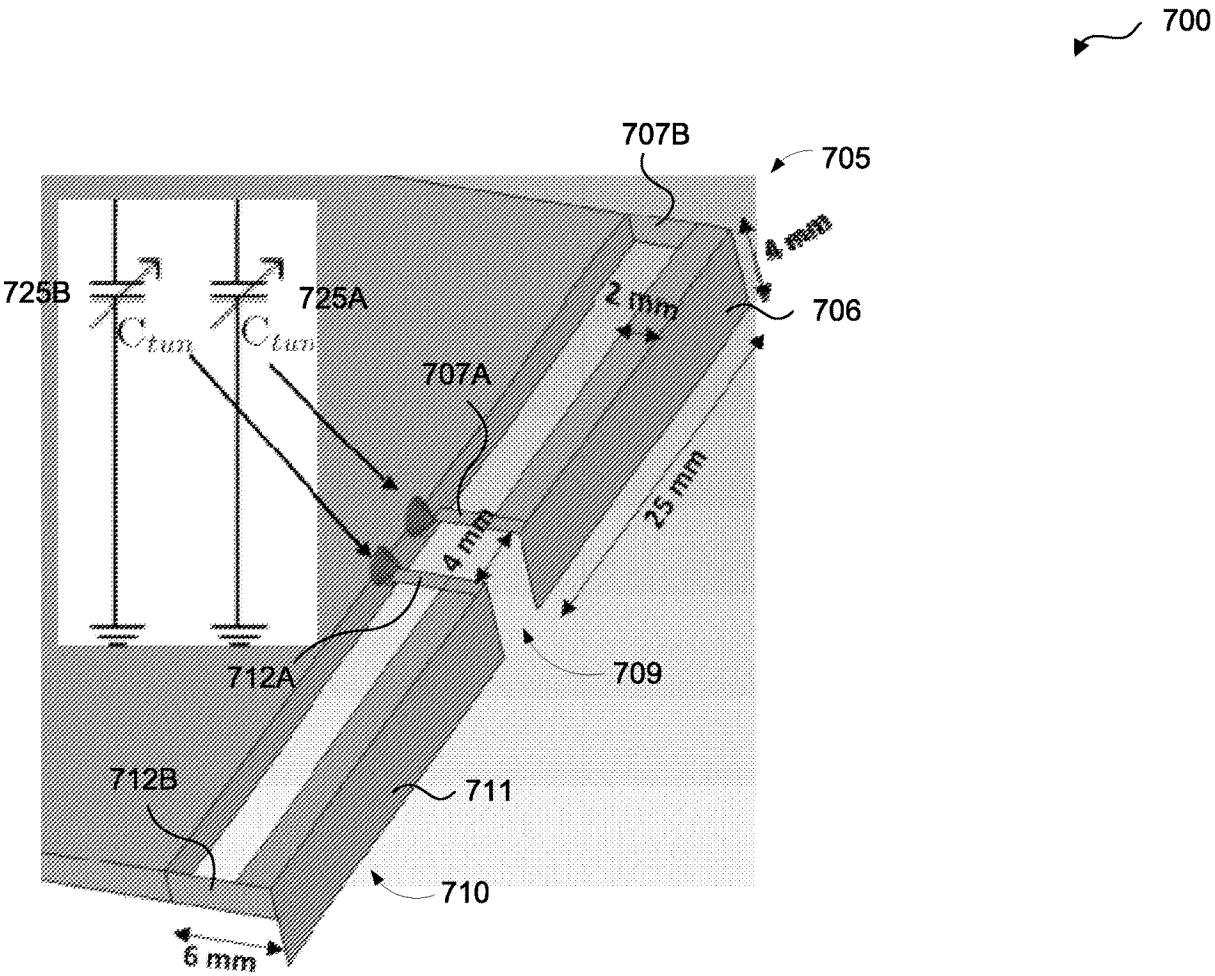
FIG. 8A illustrates an antenna system and corresponding circuit diagram according to an exemplary aspect of the present disclosure.

In an exemplary aspect and with reference to FIG. 8A, the first radiator 705 and the second radiator 710 can have a length of, for example, 25 mm. The height of the radiators 705, 710 can be, for example, 4 mm. In an exemplary aspect, the radiators 705, 710 have a bent portion that is arranged substantially parallel to the top surface of the PCB 720. The bent portion and have a width of, for example, 2 mm. A space 709 can be formed between the radiators 705, 710 that has a length of, for example, 4 mm. The dimensions should not be limited to these exemplary values, and the first radiator 705 and/or the second radiator 710 can have other dimensions as would be understood by one of ordinary skill in the relevant arts. In an exemplary aspect, the lengths of the first radiator 705 and the second radiator 710 can have different dimensions from each other such that one of the radiators 705, 710 is longer than the other.

FIG. 8A illustrates antenna system 700 and a circuit diagram of the radiators 705 and 710 according to an exemplary aspect of the present disclosure. To allow for the discussion of the configuration of the radiators 705, 710, the electromagnetic coupler 715 has been removed to expose the connections of the radiators 705, 710 to the PCB 720. Although example dimensions are shown in FIG. 8A, the exemplary aspects are not limited to these dimensions.

In an exemplary aspect, the first radiator 705 includes a first radiation portion 706 that is connected to the PCB 720 via leads 707A and 707B. The first radiator 705 can include a capacitor 725A is connected between the lead 707A and ground of the PCB 720. The other end of the first radiation portion 706 can be connected to ground of the PCB 720 via lead 707B. In an exemplary aspect, the capacitor 725A can be a tunable capacitor. However, the capacitor 725A can be a fixed capacitor in one or more of the aspects. In an exemplary aspect, the capacitor 725A can have a capacitance of, for example, 0.8-5 pF, 0.9-5 pF, 0.92-4.61 pF, 1.73-4.49 pF, 1.73-3.89 pF, 0.92 pF, 1.73 pF, 2.03 pF, 2.93 pF, 3.23 pF, or one or more other capacitances or tunable capacitance ranges as would be understood by those skilled in the relevant arts.

In an exemplary aspect, the second radiator 710 includes a second radiation portion 711 that is connected to the PCB 720 via leads 712A and 712B. The second radiator 710 can include a capacitor 725B is connected between the lead 712A and ground of the PCB 720. The other end of the second radiation portion 711 can be connected to ground of the PCB 720 via lead 712B. In an exemplary aspect, the capacitor 725B can be a tunable capacitor. However, the capacitor 725B can be a fixed capacitor in one or more of the aspects. In an exemplary aspect, the capacitor 725B can have a capacitance of, for example, 0.8-5 pF, 0.9-5 pF, 0.92-4.61 pF, 1.73-3.89 pF, 0.92 pF, 1.73 pF, 2.03 pF, 2.93 pF, 3.23 pF, or one or more other capacitances or tunable capacitance ranges as would be understood by those skilled in the relevant arts. In exemplary aspects, the capacitance of capacitor 725A can be the same or different from the capacitance of capacitor 725B.

Figure 8B:
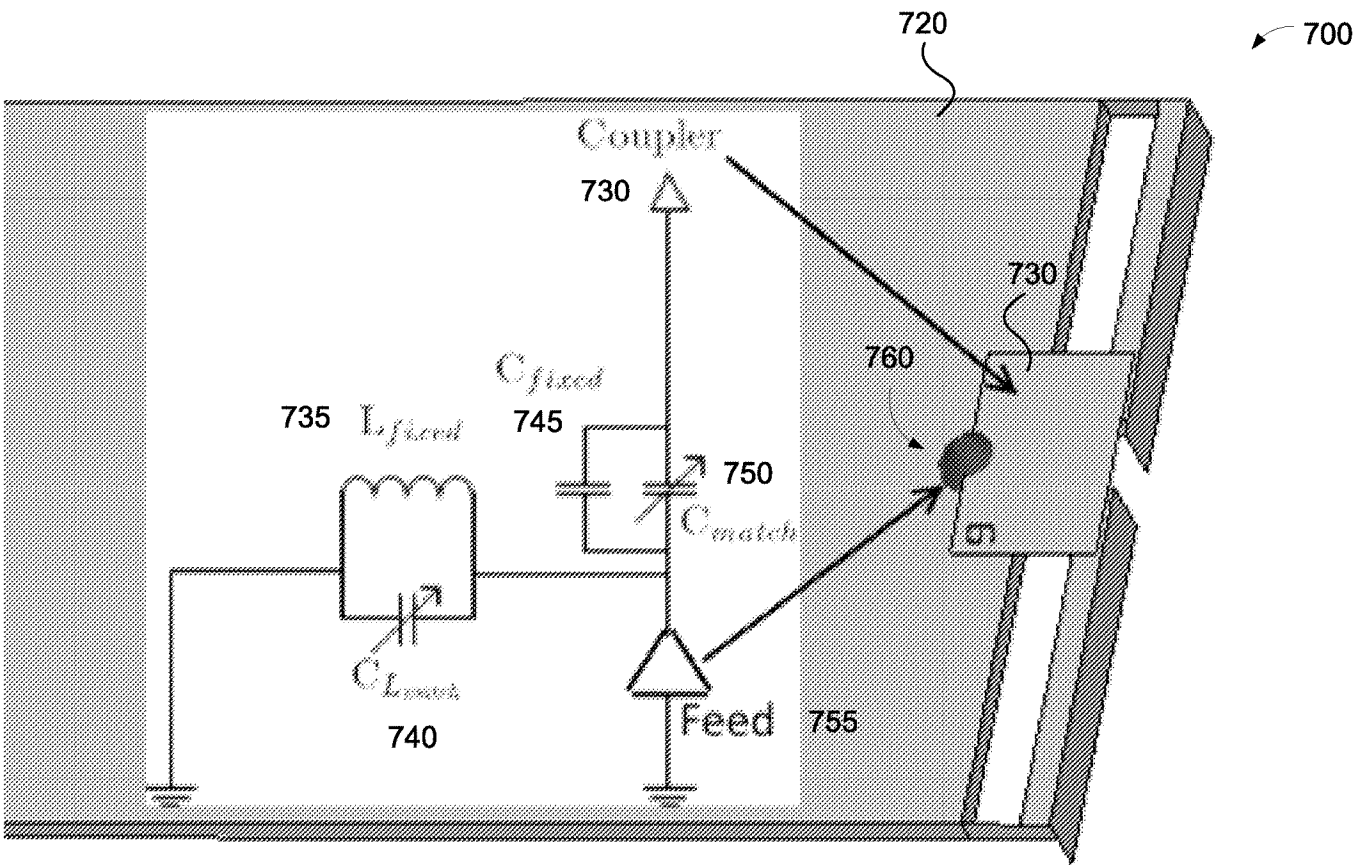
FIG. 8B illustrates an antenna system and corresponding circuit diagram according to an exemplary aspect of the present disclosure.

FIG. 8B illustrates antenna system 700 and a circuit diagram of electromagnetic coupler 715 according to an exemplary aspect of the present disclosure.

The electromagnetic coupler 715 can include a coupling portion 730 that is disposed on a portion of the PCB 720, the space 709, a portion of the first radiator 705 and a portion of the second radiator 710. In an exemplary aspect, the coupling portion 730 is a planar-shaped device as illustrated in FIG. 8B.

In an exemplary aspect, the coupling portion 730 is connected to a feed 755 via one or more active or passive components (e.g., one or more capacitors, inductors, resistors, etc.). For example, the coupling portion 730 can be connected to feed 755 via a capacitor 745 and capacitor 750 that are connected in parallel. In an exemplary aspect, capacitor 745 is a fixed capacitor and the capacitor 750 is a tunable capacitor. In exemplary aspects, the capacitors 745 and 750 can both be fixed, both be tunable, or one can be fixed while the other is tunable. The coupling portion 730 can be further connected to ground via one or more other active or passive components (e.g., one or more capacitors, inductors, resistors, etc.) that are connected between ground and the electrical node between the feed 755 and the capacitors 745 and 750. In an exemplary aspect, inductor 735 and capacitor 740 are connected in parallel and between ground and the electrical node between the feed 755 and the capacitors 745 and 750. In an exemplary aspect, the capacitor 740 is a tunable capacitor. However, the capacitor 740 can be fixed in one or more of the exemplary aspects. The inductor 735, capacitors 740, 745 and 750, and feed 755 can be collectively illustrated by 760 in FIG. 8B.

In this configuration, the coupling portion is connected to ground via capacitors 745 and 750 connected in parallel and inductor 735 and capacitor 740 connected in parallel and in series with the capacitors 745 and 750. The feed 755 is connected between ground and the electrical node formed between the capacitors 745 and 750 connected in parallel and inductor 735 and capacitor 740 connected in parallel.

In an exemplary aspect, inductor 735 can have an inductance of, for example, 8 nH, 8.2 nH, 8.5 nH, 9 nH, or one or more other inductances as would be understood by those skilled in the relevant arts. The capacitor 740 can have a capacitance of, for example, 0.8-7 pF, 0.9-6 pF, 1.25-6 pF, 1.38-6 pF, or one or more other capacitances or tunable capacitance ranges as would be understood by those skilled in the relevant arts. The capacitor 745 can have a capacitance of, for example, 1 pF, 2 pF, 2.4 pF, 2.5 pF, or one or more other capacitances or tunable capacitance ranges as would be understood by those skilled in the relevant arts. The capacitor 750 can have a capacitance of, for example, 0.1-2 pF, 0.15-2 pF, 0.16-1.96 pF, or one or more other capacitances or tunable capacitance ranges as would be understood by those skilled in the relevant arts. In one or more of the exemplary aspects, the value of the capacitors 740, 745 and/or 750, and/or the value of the inductor 735 are a function of the dimensions of the coupler 715. In exemplary aspects in which the coupler 715 is designed with different dimensions, the values of in the circuitry (values of the capacitors 740, 745 and/or 750, and/or the value of the inductor 735) can be adjusted accordingly.

Example 1 is an antenna system of a communication device, comprising: a first radiator; a second radiator being spaced from the first radiator; and an electromagnetic coupler disposed adjacent to the first radiator, the second radiator, the first and the second radiators being separated by a space, the electromagnetic coupler being configured to couple the first and the second radiators to the communication device.

In Example 2, the subject matter of Example 1, wherein the first radiator comprises a first tunable capacitor and a first radiation portion coupled to the first tunable capacitor; and wherein the second radiator comprises a second tunable capacitor and a second radiation portion coupled to the second tunable capacitor.

In Example 3, the subject matter of Example 2, wherein the first radiator further comprises a first inductor, the first radiation portion being coupled to the first tunable capacitor via the first inductor; and wherein the second radiator comprises a second inductor, the second radiation portion being coupled to the second tunable capacitor via the second inductor.

In Example 4, the subject matter of Example 3, wherein: a first end of the first radiation portion is floating; a second end of the first radiation portion is coupled to the first tunable capacitor, the first tunable capacitor being coupled to ground via the first tunable capacitor, the second end of the first radiation portion being opposite the first end of the first radiation portion; a first end of the second radiation portion is coupled to the ground; and a second end of the second radiation portion is coupled to the ground via the second tunable capacitor, the second end of the second radiation portion being opposite the first end of the second radiation portion.

In Example 5, the subject matter of Example 2, wherein: a first end of the first radiation portion is coupled to ground; a second end of the first radiation portion is coupled to the ground via the first tunable capacitor, the second end of the first radiation portion being opposite the first end of the first radiation portion; a first end of the second radiation portion is coupled to the ground; and a second end of the second radiation portion is coupled to the ground via the second tunable capacitor, the second end of the second radiation portion being opposite the first end of the second radiation portion.

In Example 6, the subject matter of Example 5, The antenna system of claim 5, wherein the first end of the first radiation portion is coupled to ground via one or more capacitors, one or more inductors, or a combination thereof.

In Example 7, the subject matter of Example 5, wherein the second end of the first radiation portion is adjacent to the second end of the second radiation portion, the space formed between the first and the second radiators being defined by the second end of the first radiation portion and the second end of the second radiation portion.

In Example 8, the subject matter of Example 1, wherein the first radiator has a first length and the second radiator has a second length shorter than the first length.

In Example 9, the subject matter of Example 1, wherein the electromagnetic coupler is an inductive coupler configured to inductively couple the first and the second radiators to the communication device.

In Example 10, the subject matter of Example 1, wherein the electromagnetic coupler is a capacitive coupler configured to capacitively couple the first and the second radiators to the communication device.

In Example 11, the subject matter of Example 1, wherein the first radiator and the second radiator are included in a single antenna having the spaced formed therein.

In Example 12, the subject matter of Example 1, wherein the first radiator and the second radiator are tunable radiators, the first radiator being tunable to a first resonance and the second radiator being tunable to a second resonance different from the first resonance.

In Example 13, the subject matter of Example 1, wherein the electromagnetic coupler comprises: a coupling portion having a first end coupled to ground; a first tunable capacitor coupled between the ground and a second end of the coupling portion; and a second tunable capacitor coupled between a feed and the second end of the coupling portion.

In Example 14, the subject matter of Example 1, wherein the electromagnetic coupler comprises: a coupling portion having a first end that is floating; an inductor coupled between a second end of the coupling portion and a feed; and a capacitor coupled between ground and the inductor and the feed.

In Example 15, the subject matter of Example 14, wherein the capacitor is a tunable capacitor.

Example 16 is an antenna system of a communication device, comprising: a first radiator; a second radiator being spaced from the first radiator; and an electromagnetic coupler disposed between and spaced from the first radiator and the second radiator, the electromagnetic coupler being configured to couple the first and the second radiators to the communication device.

In Example 17, the subject matter of Example 16, wherein the first radiator comprises a first radiation portion, a first inductor, and a first tunable capacitor connected in series and coupled to ground; and wherein the second radiator comprises a second radiation portion, a second inductor, and a second tunable capacitor connected in series and coupled to the ground.

In Example 18, the subject matter of Example 17, wherein: a first end of the first radiation portion is floating and a second end of the first radiation portion that is opposite the first end of the first radiation portion is connected to the first inductor; a first end of the second radiation portion is floating and a second end of the second radiation portion that is opposite the first end of the second radiation portion is connected to the second inductor; and the first end of the first radiation portion is adjacent to the first end of the second radiation portion, the space formed between the first and the second radiators being defined by the first end of the first radiation portion and the first end of the second radiation portion.

In Example 19, the subject matter of Example 16, wherein the first radiator and the second radiator are tunable radiators, the first radiator being tunable to a first resonance and the second radiator being tunable to a second resonance different from the first resonance.

In Example 20, the subject matter of Example 16, wherein the electromagnetic coupler comprises: a coupling portion having a first end that is floating; an inductor coupled between a second end of the coupling portion and a feed; and a capacitor coupled between ground and the inductor and the feed.

Example 21 is an antenna system of a communication device, comprising: a first tunable radiator including a first radiation portion and a first tunable capacitor, the first radiation portion having a first end coupled to ground via the first tunable capacitor; a second tunable radiator being spaced from the first tunable radiator, the second tunable radiator including a second radiation portion and a second tunable capacitor, wherein the second radiation portion has a first end coupled to the ground via the second tunable capacitor; and an electromagnetic coupler disposed adjacent to the first radiator and the second radiator.

In Example 22, the subject matter of Example 21, wherein the electromagnetic coupler comprises: a coupling portion; first and second capacitors connected in series and connected to the coupling portion; and a third capacitor and an inductor connected in parallel, the third capacitor and the inductor being connected in series between ground and the first and the second capacitors.

In Example 23, the subject matter of any of Examples 1-7, wherein the first radiator has a first length and the second radiator has a second length shorter than the first length.

In Example 24, the subject matter of any of Examples 1, 2, and 5-7, wherein the electromagnetic coupler is an inductive coupler configured to inductively couple the first and the second radiators to the communication device.

In Example 25, the subject matter of any of Examples 1-4, wherein the electromagnetic coupler is a capacitive coupler configured to capacitively couple the first and the second radiators to the communication device.

In Example 26, the subject matter of any of Examples 1-7, wherein the first radiator and the second radiator are included in a single antenna having the spaced formed therein.

In Example 27, the subject matter of any of Examples 1-7, wherein the first radiator and the second radiator are tunable radiators, the first radiator being tunable to a first resonance and the second radiator being tunable to a second resonance different from the first resonance.

In Example 28, the subject matter of any of Examples 1, 2, and 5-7, wherein the electromagnetic coupler comprises: a coupling portion having a first end coupled to ground; a first tunable capacitor coupled between the ground and a second end of the coupling portion; and a second tunable capacitor coupled between a feed and the second end of the coupling portion.

In Example 29, the subject matter of any of Examples 1-4, wherein the electromagnetic coupler comprises: a coupling portion having a first end that is floating; an inductor coupled between a second end of the coupling portion and a feed; and a capacitor coupled between ground and the inductor and the feed.

In Example 30, the subject matter of Example 29, wherein the capacitor is a tunable capacitor.

In Example 31, the subject matter of any of Examples 16-18, wherein the first radiator and the second radiator are tunable radiators, the first radiator being tunable to a first resonance and the second radiator being tunable to a second resonance different from the first resonance.

In Example 32, the subject matter of any of Examples 16-18, wherein the electromagnetic coupler comprises: a coupling portion having a first end that is floating; an inductor coupled between a second end of the coupling portion and a feed; and a capacitor coupled between ground and the inductor and the feed.

In Example 33, the subject matter of Example 32, wherein the first radiator and the second radiator are tunable radiators, the first radiator being tunable to a first resonance and the second radiator being tunable to a second resonance different from the first resonance.

Example 34 is an antenna system of a communication device, comprising: a first radiating means; a second radiating means spaced from the first radiating means; and an electromagnetic coupling means disposed adjacent to the first radiating means, the second radiating means, the first and the second radiating means being separated by a space, the electromagnetic coupling means for coupling the first and the second radiating means to the communication device.

In Example 35, the subject matter of Example 34, wherein the first radiating means comprises a first tunable capacitor and a first radiation means coupled to the first tunable capacitor; and wherein the second radiating means comprises a second tunable capacitor and a second radiation means coupled to the second tunable capacitor.

In Example 36, the subject matter of Example 35, wherein the first radiating means further comprises a first inductor, the first radiation means being coupled to the first tunable capacitor via the first inductor; and wherein the second radiating means comprises a second inductor, the second radiation means being coupled to the second tunable capacitor via the second inductor.

In Example 37, the subject matter of Example 36, wherein: a first end of the first radiation means is floating; a second end of the first radiation means is coupled to the first tunable capacitor, the first tunable capacitor being coupled to ground via the first tunable capacitor, the second end of the first radiation means being opposite the first end of the first radiation means; a first end of the second radiation means is coupled to the ground; and a second end of the second radiation means is coupled to the ground via the second tunable capacitor, the second end of the second radiation means being opposite the first end of the second radiation means.

In Example 38, the subject matter of Example 35, wherein: a first end of the first radiation means is coupled to ground; a second end of the first radiation means is coupled to the ground via the first tunable capacitor, the second end of the first radiation means being opposite the first end of the first radiation means; a first end of the second radiation means is coupled to the ground; and a second end of the second radiation means is coupled to the ground via the second tunable capacitor, the second end of the second radiation means being opposite the first end of the second radiation means.

In Example 39, the subject matter of Example 38, wherein the first end of the first radiation means is coupled to ground via one or more capacitors, one or more inductors, or a combination thereof.

In Example 40, the subject matter of Example 38, wherein the second end of the first radiation means is adjacent to the second end of the second radiation means, the space formed between the first and the second radiating means being defined by the second end of the first radiation means and the second end of the second radiation means.

In Example 41, the subject matter of any of Examples 34-40, wherein the first radiating means has a first length and the second radiating means has a second length shorter than the first length.

In Example 42, the subject matter of any of Examples 34, 35, and 38-40, wherein the electromagnetic coupling means is an inductive coupling means for inductively coupling the first and the second radiating means to the communication device.

In Example 43, the subject matter of any of Examples 34-37, wherein the electromagnetic coupling means is a capacitive coupling means for capacitively coupling the first and the second radiating means to the communication device.

In Example 44, the subject matter of any of Examples 34-40, wherein the first radiating means and the second radiating means are included in a single antenna having the spaced formed therein.

In Example 45, the subject matter of any of Examples 34-40, wherein the first radiating means and the second radiating means are tunable radiating means, the first radiating means being tunable to a first resonance and the second radiating means being tunable to a second resonance different from the first resonance.

In Example 46, the subject matter of any of Examples 34, 35, and 38-40, wherein the electromagnetic coupling means comprises: a coupling means having a first end coupled to ground; a first tunable capacitor coupled between the ground and a second end of the coupling means; and a second tunable capacitor coupled between a feed and the second end of the coupling means.

In Example 47, the subject matter of any of Examples 34-37, wherein the electromagnetic coupling means comprises: a coupling means having a first end that is floating; an inductor coupled between a second end of the coupling means and a feed; and a capacitor coupled between ground and the inductor and the feed.

In Example 48, the subject matter of Example 47, wherein the capacitor is a tunable capacitor.

CONCLUSION

The aforementioned description of the specific aspects will so fully reveal the general nature of the disclosure that others can, by applying knowledge within the skill of the art, readily modify and/or adapt for various applications such specific aspects, without undue experimentation, and without departing from the general concept of the present disclosure. Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one aspect," "an aspect," "an exemplary aspect," etc., indicate that the aspect described may include a particular feature, structure, or characteristic, but every aspect may not necessarily include the particular feature, structure, or characteristic. Moreover, such phrases are not necessarily referring to the same aspect. Further, when a particular feature, structure, or characteristic is described in connection with an aspect, it is submitted that it is within the knowledge of one skilled in the art to affect such feature, structure, or characteristic in connection with other aspects whether or not explicitly described.

The exemplary aspects described herein are provided for illustrative purposes, and are not limiting. Other exemplary aspects are possible, and modifications may be made to the exemplary aspects. Therefore, the specification is not meant to limit the disclosure. Rather, the scope of the disclosure is defined only in accordance with the following claims and their equivalents.

Aspects may be implemented in hardware (e.g., circuits), firmware, software, or any combination thereof. Aspects may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, code, or a combination thereof. For example, a circuit can include an analog circuit, a digital circuit, state machine logic, other structural electronic hardware, or a combination thereof. A processor can include a microprocessor, a digital signal processor (DSP), or other hardware processor. The processor can be "hard-coded" with instructions to perform corresponding function(s) according to aspects described herein. Alternatively, the processor can access an internal and/or external memory to retrieve instructions stored in the memory, which when executed by the processor, perform the corresponding function(s) associated with the processor, and/or one or more functions and/or operations related to the operation of a component having the processor included therein.

The term "module" shall be understood to include one of software, firmware, hardware (such as circuits, microchips, processors, or devices, or any combination thereof), or any combination thereof. In addition, it will be understood that each module can include one or more components within an actual device, and each component that forms a part of the described module can function either cooperatively or independently of any other component forming a part of the module. Conversely, multiple modules described herein can represent a single component within an actual device. Further, components within a module can be in a single device or distributed among multiple devices in a wired or wireless manner.

What is claimed is:

1. An antenna system of a communication device, comprising:

a first radiator including a first tunable capacitor and a first radiation portion coupled to the first tunable capacitor;

a second radiator including a second tunable capacitor and a second radiation portion coupled to the second tunable capacitor, the second radiator being separated from the first radiator by a space, wherein the first and the second radiators are coplanar; and an electromagnetic coupler disposed adjacent to the first radiator and the second radiator, wherein a line extending perpendicular to a plane of the first and the second radiators passes through the space and the electromagnetic coupler, and wherein the electromagnetic coupler is configured to couple the first and the second radiators to the communication device.

2. The antenna system of claim 1, wherein:

the first radiator further comprises a first inductor, the first radiation portion being coupled to the first tunable capacitor via the first inductor; and the second radiator comprises a second inductor, the second radiation portion being coupled to the second tunable capacitor via the second inductor.

3. The antenna system of claim 2, wherein:

a first end of the first radiation portion is floating;

a second end of the first radiation portion is coupled to the first tunable capacitor, the first tunable capacitor being coupled to ground via the first tunable capacitor, the second end of the first radiation portion being opposite the first end of the first radiation portion;

a first end of the second radiation portion is coupled to the ground; and a second end of the second radiation portion is coupled to the ground via the second tunable capacitor, the second end of the second radiation portion being opposite the first end of the second radiation portion.

4. The antenna system of claim 1, wherein:

a first end of the first radiation portion is coupled to ground;

a second end of the first radiation portion is coupled to the ground via the first tunable capacitor, the second end of the first radiation portion being opposite the first end of the first radiation portion;

a first end of the second radiation portion is coupled to the ground; and a second end of the second radiation portion is coupled to the ground via the second tunable capacitor, the second end of the second radiation portion being opposite the first end of the second radiation portion.

5. The antenna system of claim 4, wherein the first end of the first radiation portion is coupled to ground via one or more capacitors, one or more inductors, or a combination thereof.

6. The antenna system of claim 4, wherein the second end of the first radiation portion is adjacent to the second end of the second radiation portion, the space formed between the first and the second radiators being defined by the second end of the first radiation portion and the second end of the second radiation portion.

7. The antenna system of claim 1, wherein the first radiator has a first length and the second radiator has a second length shorter than the first length.

8. The antenna system of claim 1, wherein the electromagnetic coupler is an inductive coupler configured to inductively couple the first and the second radiators to the communication device.

9. The antenna system of claim 1, wherein the electromagnetic coupler is a capacitive coupler configured to capacitively couple the first and the second radiators to the communication device.

10. The antenna system of claim 1, wherein the first radiator and the second radiator are included in a single antenna having the spaced formed therein.

11. The antenna system of claim 1, wherein the first radiator and the second radiator are tunable radiators, the first radiator being tunable to a first resonance and the second radiator being tunable to a second resonance different from the first resonance.

12. The antenna system of claim 1, wherein the electromagnetic coupler comprises:

a coupling portion having a first end coupled to ground;

a first tunable capacitor coupled between the ground and a second end of the coupling portion; and a second tunable capacitor coupled between a feed and the second end of the coupling portion.

13. The antenna system of claim 1, wherein the electromagnetic coupler comprises:

a coupling portion having a first end that is floating;

an inductor coupled between a second end of the coupling portion and a feed; and a capacitor coupled between ground and the inductor and the feed.

14. The antenna system of claim 13, wherein the capacitor is a tunable capacitor.

15. The antenna system of claim 1, wherein the electromagnetic coupler extends parallel to the plane of the first radiator and the second radiator.

16. The antenna system of claim 1, wherein the electromagnetic coupler is disposed in a plane that is perpendicular to the plane of the first radiator and the second radiator.

17. An antenna system of a communication device, comprising:

a first tunable radiator including a first radiation portion and a first tunable capacitor, the first radiation portion having a first end coupled to ground via the first tunable capacitor;

a second tunable radiator being spaced from the first tunable radiator, the second tunable radiator including a second radiation portion and a second tunable capacitor, wherein the second radiation portion has a first end coupled to the ground via the second tunable capacitor; and an electromagnetic coupler disposed adjacent to the first radiator and the second radiator.

18. The antenna system of claim 17, wherein the electromagnetic coupler comprises:

a coupling portion;

first and second capacitors connected in series and connected to the coupling portion; and a third capacitor and an inductor connected in parallel, the third capacitor and the inductor being connected in series between ground and the first and the second capacitors.

19. The antenna system of claim 17, wherein:

the first and the second tunable radiators are coplanar;

the second tunable radiator is spaced from the first tunable radiator by a space; and a line extending perpendicular to a plane of the first and the second tunable radiators passes through the space and the electromagnetic coupler.

20. The antenna system of claim 17, wherein the electromagnetic coupler comprises:

a coupling portion having a first end that is floating;

an inductor coupled between a second end of the coupling portion and a feed; and a capacitor coupled between ground and the inductor and the feed.

21. An antenna system of a communication device, comprising:

a first radiator;

a second radiator being separated from the first radiator by a space; and an electromagnetic coupler disposed adjacent to the first radiator and the second radiator, the electromagnetic coupler being configured to couple the first and the second radiators to the communication device, wherein the electromagnetic coupler comprises:

a coupling portion having a first end that is floating;

an inductor coupled between a second end of the coupling portion and a feed; and a capacitor coupled between ground and the inductor and the feed.

* * * * *